United States Patent [19]

Abramson

[11] 4,132,101

[45] Jan. 2, 1979

[54] CRIMPING APPARATUS

[76] Inventor: Joseph O. Abramson, 5629 Edgewater Dr., Orlando, Fla. 32810

[21] Appl. No.: 829,178

[22] Filed: Aug. 31, 1977

[51] Int. Cl.[2] ..... B21D 37/12

[52] U.S. Cl. ..... 72/324; 72/452; 72/472; 72/416

[58] Field of Search ..... 72/412, 416, 452, 415, 72/404, 410, 429, 472; 72/324

[56] References Cited

U.S. PATENT DOCUMENTS

| | | | |
|---|---|---|---|
| 1,677,251 | 7/1928 | Saffold | 72/452 |
| 1,677,659 | 7/1928 | Saffold | 72/452 |
| 3,128,654 | 4/1964 | Herrstrum | 72/452 |
| 3,216,091 | 11/1965 | Floyd | 72/416 |
| 3,260,098 | 7/1966 | Gill | 72/416 |
| 3,406,247 | 10/1968 | Parsons | 72/324 |
| 3,553,999 | 1/1971 | Rommel | 72/324 |
| 4,027,519 | 6/1977 | Bachle | 72/412 |

FOREIGN PATENT DOCUMENTS

| | | | |
|---|---|---|---|
| 570720 | 7/1945 | United Kingdom | 72/415 |

*Primary Examiner*—C.W. Lanham
*Assistant Examiner*—Gene P. Crosby
*Attorney, Agent, or Firm*—Roylance, Abrams, Berdo & Farley

[57] ABSTRACT

A crimping apparatus includes a base member and a platen member, movable relative to each other, with each carrying a jaw member having a crimping recess therein. An eccentrically mounted manually rotatable disc member acts as a cam to move the platen member relatively toward the base member to bring the jaw members into contact with one another. The crimping recesses are generally Y-shaped in configuration to cause the item to be crimped to have a crimped section which is diamond-shaped in cross-sectional configuration.

13 Claims, 8 Drawing Figures

CRIMPING APPARATUS

This invention relates to a crimping apparatus and more particularly it relates to a manually operable crimping apparatus which is capable of producing a highly effective crimp along a portion or section of a member which is to be crimped.

In my co-pending application Ser. No. 701,682, filed July 1, 1976 and now U.S. Pat. No. 4,060,304, such application being entitled "Battery Cables And Process For Making Same" I have set forth in detail a new and improved form of battery cable having a metallic sleeve which is crimped on to the stripped end portion of a multistrand electrically conductive cable. The crimping apparatus of the present invention is advantageous and useful in forming the crimp in such metallic sleeve for the purpose of attaching such sleeve to the electrically conductive cable. The crimping apparatus set forth herein is likewise useful in other forms of crimping operations wherein it is desired to attach an overlying member to an underlying member by means of a crimping operation.

Various forms of crimping apparatus and crimping tools have been known in the art and have been used for the purpose of producing crimped portions in items which are to be crimped. Some forms of crimping apparatus have simply been hand tools, much in the form of pliers, which are manually squeezed to perform the crimping operation. The difficulty with hand tools of this type is that the crimp formation depends to some degree upon the strength and accuracy of the operator. Other forms of crimping apparatus have been in the form of complicated apparatus, usually designed to perform several operations besides crimping, and while apparatus of this type can and does form a satisfactory crimp, it is also expensive to produce and complicated to operate.

In contrast with the foregoing, the crimping apparatus of the present invention is simple, yet efficient, and is capable of being operated by even an untrained or unskilled operator.

In addition, the objective of the present invention is to provide a crimping apparatus which produces exactly the same crimp, time after time, so long as the crimping jaws remain the same, with each crimp being exact and without variation from one crimp to another.

Another object of the present invention is to provide a highly efficient form of crimping apparatus which can be quickly and easily operated and which produces a powerful crimp which will not fail or separate even after repeated use.

Another object of the present invention is to provide a crimping apparatus which is particularly useful in crimping a metallic sleeve on to the stripped portion of a multi-strand electrically conductive cable, such as the type of cable used for automotive battery cables.

Other objects, advantages and salient features of the present invention will become apparent from the following detailed description, which, taken in conjunction with the annexed drawings, discloses a preferred embodiment thereof.

The foregoing objects are attained by providing a crimping apparatus which includes a base member having a pair of posts attached thereto and projecting upwardly therefrom, such posts being disposed in spaced parallel relation. A movable platen member is provided with a pair of spaced bores therein and is mounted above the base member with the posts projecting through the bores. A compression spring surrounds each post and reacts between the top of the base member and the bottom of the platen member, with such compression springs serving to normally bias the platen member away from the base member. The posts continue to project upwardly beyond the platen member and a cap member is mounted adjacent the upper end of each The foregoing objects are attained by providing a crimping apparatus which includes a base member having a pair of posts attached thereto and projecting upwardly therefrom, such posts being disposed in spaced parallel relation. A movable platen member is provided with a pair of spaced bores therein and is mounted above the base member with the posts projecting through the bores. A compression spring surrounds each post and reacts between the top of the base member and the bottom of the platen member, with such compression springs serving to normally bias the platen member away from the base member. The posts continue to project upwardly beyond the platen member and a cap member is mounted adjacent the upper end of each post. A pivot shaft extends transversely between the cap members and serves as a mounting means for a rotatable disc member.

The rotatable disc member is of a circular configuration, having a pair of opposed side faces and having a circular peripheral edge which extends between the side faces. The disc member is provided with a transverse bore extending therethrough, offset from the center of the circular disc. The pivot shaft extends through the bore in this disc and thus serves to mount the disc eccentrically with respect to its center of rotation. A freely movable roller is disposed along the upper surface of the platen member. The peripheral edge of the disc engages with this freely movable roller and rolls thereupon. An operating handle is connected with the circular disc, preferably by inserting the same into an opening in the peripheral edge of the disc. This arrangement permits the handle to be grasped and manually turned, thereby causing the rotatable disc member to act as a cam which moves the platen member downward toward the base member, thus overcoming the biasing force of the compression springs.

A pair of opposed jaw members are provided in confronting relation to one another. The lower jaw member is attached to the base member between the upstanding posts. The upper jaw member is attached to the bottom surface of the movable platen and is aligned with and above the lower jaw member. Each jaw member is provided with a crimping recess therein, with the respective recesses facing toward one another. Advantageously, the crimping recesses are generally Y-shaped in configuration so that when the jaw members are moved into contact with one another, the crimping recesses serve to deform the item positioned therebetween into a crimp of generally diamondshaped configuration in cross section.

The jaw members of the crimping apparatus of the present invention can also include a pair of cutting blades disposed to one side of the crimping recesses, such cutting blades coacting when the jaws are moved together to sever any item placed therebetween. The crimping jaws of the present invention can also include a pair of semi-cylindrical recesses which coact, when the jaws are moved together, to form a cylindrical impression in an item placed therein.

Referring now to the drawings which form a part of this original disclosure:

Figure 1:
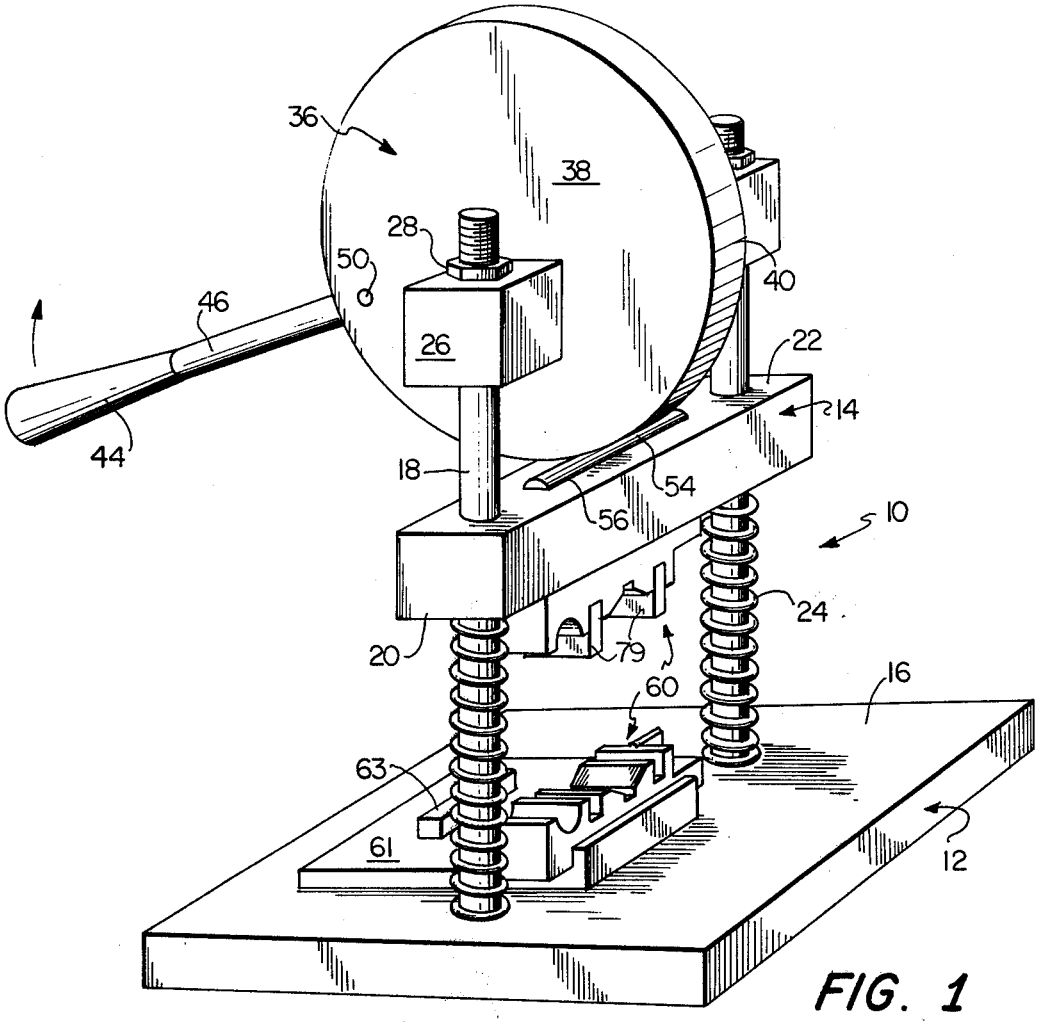
FIG. 1 is a perspective view of the crimping apparatus in accordance with the principles of the present invention.

Referring now to the invention in further detail, the crimping apparatus is shown in FIG. 1 and is generally designated 10. Such apparatus includes a base member generally designated 12 and a movable platen member generally designated 14. The base member 12 includes a flat upper surface 16 from which a pair of spaced parallel posts 18 project upwardly, in perpendicular relationship to the upper surface 16 on the base member. The platen 14 includes a lower surface 20 and an upper surface 22. A pair of coil compression springs 24 are provided in surrounding relationship to the posts 18 between the platen member 14 and the base member 12. Specifically, the springs 24 act against the upper surface 16 of the base member and the lower surface 20 of the platen member, thus normally urging the platen member away from the base member.

Figure 3:
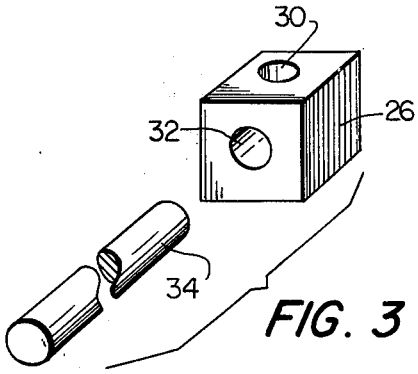
FIG. 3 is an exploded perspective view of a cap member and the pivot shaft used in the apparatus.

Cap members 26 are mounted at the upper ends of the posts 18 and are attached thereto by nuts 28 which advantageously thread on to the ends of the post members 18. As can best be seen from FIG. 3, each cap member 26 has a vertical bore 30 extending therethrough for passage of the post members 18 through the cap member. Although not illustrated, it will be understood that the post members 18 can be provided with a shoulder upon which the cap members 26 can seat. The cap members 26 also include a transversely extending blind end bore 32, with the bore 32 on one cap member being directed toward and facing the bore 32 on the opposite cap member. A pivot shaft 34 extends transversely between the opposed cap members 26, with the ends of the pivot shaft 34 fitting into the blind end bores 32.

Figure 2:
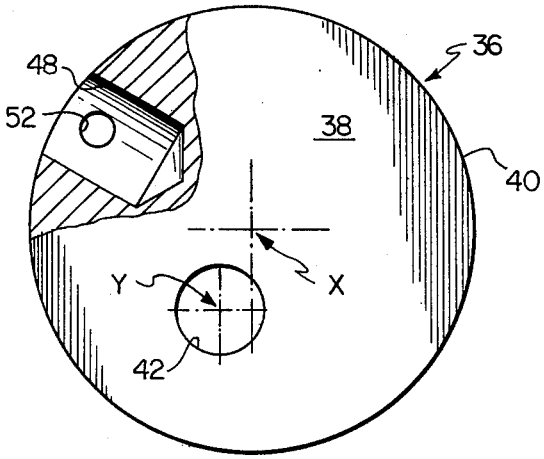
FIG. 2 is a side elevational view, partly in section, of the circular disc member which forms the cam in the present invention.

A circular disc member generally designated 36 is mounted between the cap members 26 and disposed above the platen member 14. The circular member 36 has a pair of opposed side faces 38 and a circular peripheral edge 40 extending between the side faces. As shown in FIG. 2, the disc member 36 has a transverse bore 42 extending therethrough, such bore being adapted to receive, and hence to mount the circular disc 36 upon, the pivot shaft 34. The bore 42 is offset from the center of the disc member 36. As illustrated in FIG. 2, the true center of the circular disc member 36 is designated X. The center of the bore 42 is designated Y, and, as can be seen from FIG. 2, the point Y is offset from the point X. Such an arrangement obviously assures that the rotatable disc member 38 is eccentrically mounted upon the pivot shaft 34.

An operating handle 44 attached to the end of a shaft 46 is utilized for rotating the disc member. The end of the shaft 46 fits into a blind end bore 48 formed in the disc member 36 as illustrated in FIG. 2. A fastening pin 50 extends through a transverse bore 52 which passes between the faces 38 of the disc and also through the bore 48. Likewise, the shaft 46 of the operating handle is provided with a transverse bore which aligns with the bore 52 so that the fastening pin 50 attaches the handle 44 and shaft 46 to the circular disc member 36, with the handle and shaft projecting radially therefrom for manual engagement. A freely movable roller 54 is disposed within the top surface 22 of the movable platen member 14. The roller 54 is in the form of an elongated cylindrical roller which fits within, and is freely rotatable within, a semi-cylindrical recess 56. The peripheral edge 40 of the circular disc member 36 engages and rolls against the roller 54.

A pair of working jaw members generally designated 60 are provided, with one such jaw member being attached to the lower surface 20 of the platen member 14 and the other such jaw member being attached to the upper surface 16 of the base member 12. Both jaw members 60 are positioned between the posts 18 and jaw members are aligned with one another. The lowermost jaw member 60 is attached by means of a clamping plate 61 which itself attaches to the upper surface 16 of the base 12. The clamping plate 61 can also include an abutment 63 which serves as a rest for the remote end of an item being crimped or otherwise treated in the jaws 60.

Figure 5:
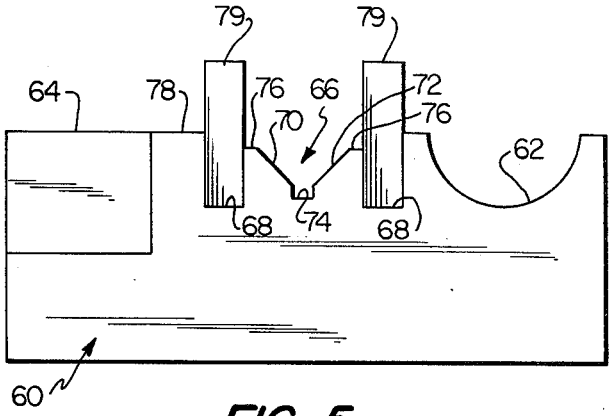
FIG. 5 is a side elevational view of one of the working jaw members used in the crimping apparatus.
Figure 6:
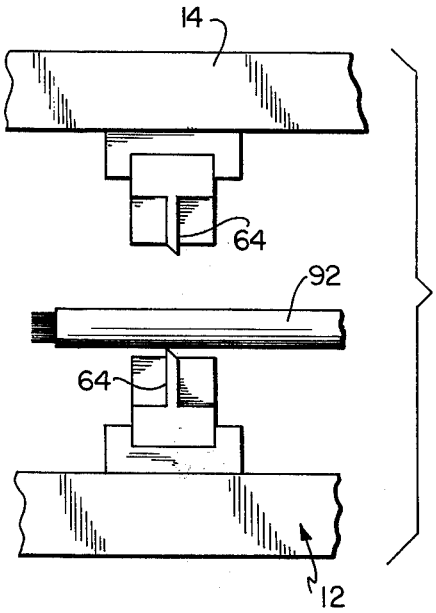
FIGS. 6 and 7 are side elevational views showing the operation of the knife edge portions of the crimping jaws, used to sever a portion of cable.
Figure 7:
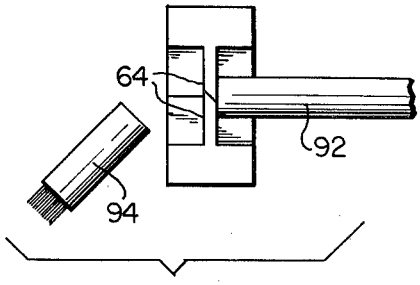

The details of the jaws 60 are more fully revealed by reference to FIG. 5 of the drawings. At one side of the jaws 60, a semi-cylindrical recess 62 is provided for purposes of scoring conductive cable insulation at a point where the insulation is to be removed. At the other side of the jaw, a flat cutting blade 64 is provided. If desired, the edge of the cutting blade 64 can be biased slightly, as shown in FIGS. 6 and 7. The crimping recess is disposed in the center of the jaw and is generally designated 66. A pair of vertical grooves 68 serve to set off and define the crimping recess portion of the jaw. The crimping recess itself is formed by a pair of angularly sloping walls 70, 72 which, in FIG. 5, slope downwardly and inwardly toward one another, then merge into a small bottom groove 74. The walls 70 and 72 and the groove 74 serve to assure that the crimping recess 66 is of a generally Y-shaped configuration. The small flat top portion 76 adjacent the crimping recess 66 is depressed slightly beneath the top 78 of the jaw member 60.

Figure 4:
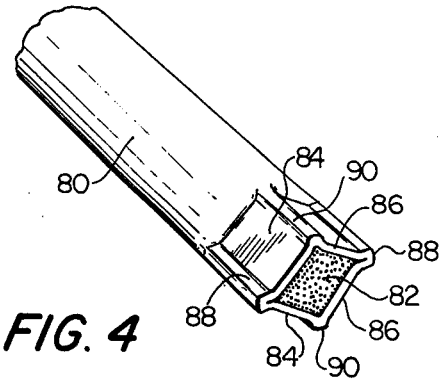
FIG. 4 is a perspective view showing the configuration of the crimp formed by the apparatus of the present invention.

Referring now to FIG. 4, there is illustrated therein a metallic sleeve 80 the end of which is crimped on to an underlying bundle of wires 82 which form the multiple strands of an electrically conductive cable, such as is used in battery cables. The crimped portion of the sleeve 80 takes a generally diamond-shaped appearance having angularly extending walls 84, 84 which are formed by the portions 70, 70 on the respective jaws and by portions 86, 86, which are formed by the portions 72, 72 on the confronting jaws. A pair of side ribs 88, 88 are formed on opposite sides of the crimp, with such ribs being formed between the confronting sections 76, 76 on the opposed jaw member. Finally, the portions 90, 90 of the crimp are formed or permitted to expand within the grooves 74, 74 of the crimping recesses on the respective jaw members.

Guide plates 79 are disposed within the grooves 68 of the upper jaw are adapted to fit into the corresponding grooves 68 in the lower jaw. This arrangement not only keeps the jaws in alignment but also assures that the crimp cannot expand laterally beyond these plates.

In a standard crimping operation, as would be used to crimp a metallic sleeve on to the stripped portion of an underlying multi-strand electrically conductive cable, the metallic sleeve would be applied over the stripped portion of the cable and the cable with the sleeve thereon would be inserted into the crimping recess 66 on the lower jaw. The abutment 63 serves to support the trailing portion of the cable. At this point, the operator grasps the handle 44 and rotates the same in the direction of the arrow of FIG. 1. Such rotation causes the circular member 36 to act as a cam as the edge 40 thereof rolls upon the roller 54. This camming action causes the platen member 14 to be depressed against the action of the springs 24 until the upper jaw is brought into contact with the lower jaw. As this occurs, the metallic sleeve is contacted on its top by the upper crimping recess and since its bottom already rests in the lower crimping recess, the action of moving the jaws together causes the metallic material to be deformed and crimped into the configuration shown in FIG. 4 which is a generally diamond-shaped configuration.

Referring to FIGS. 6 and 7, there is diagrammatically shown therein the action of the cutting blades or knife edges 64 when used to sever a cable 92. In FIG. 6, the jaws are in their normal separated position and the wire 92 is passed between the jaws and permitted to rest upon the lowermost knife edge 64. When the handle 44 is operated to cause the cam to depress the platen member, the jaws are moved together in the manner shown in FIG. 6, thereby severing a piece 94 from the end of the cable 92. Such a severing operation can precede the crimping operation or can simply be an ancillary function of the crimping apparatus 10 of the present invention.

Figure 8:
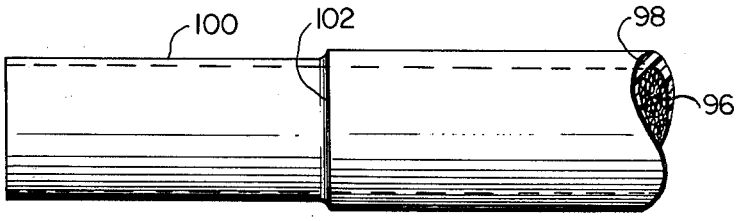
FIG. 8 is a side elevational view of a cable showing a portion thereof as compressed by the semi-cylindrical recesses formed in the jaw members.

Finally, with reference to FIG. 8, there is shown therein a typical electrically conductive cable having a multiplicity of electrically conductive strands 96 surrounded by a protective covering or sheath 98. When the end of the cable shown in FIG. 8 is inserted into the lowermost semi-cylindrical portion 62 of the jaws, and the device is again operated through manual operation of the handle 44, thereby bringing the upper jaw into contact with the lower jaw, the coacting semi-cylindrical recesses 62 serve to form a cylindrical impression 100 along the cable of FIG. 8. In actuality, the operation of these recesses 62, 62 causes both the protective sheath 98 and the underlying cables 96 to be compressed slightly. Such compression forms a clear line of demarcation which is designated 102 in FIG. 8. Thus, when the cable is removed from the jaws, this line 102 acts as the indicator for where the protective sheath 98 is to be stripped away from the cable. Such stripping can be accomplished through the use of a knife or any conventional wire stripping tool. Naturally, when such stripping takes place, the underlying bundle of wire or cable 96 will have an exposed portion. Ordinarily, this exposed portion is then covered by a metallic sleeve which is then crimped on to the cable by operation of the crimping device 10. Such a crimping operation creates a satisfactory electrical conduit.

It should be apparent that various changes and modifications may be made by those skilled in the art without departing from the spirit and scope of the invention as defined in the appended claims.

I claim:

1. Apparatus for attaching a metallic sleeve to a multi-strand electrically conductive cable, comprising:

a base member;

a platen member disposed above said base member and movable relatively thereto;

a pair of opposed working jaw members, one of which is attached to said platen member and the other of which is attached to said base member;

operating means for moving said platen member and its attached jaw member toward said base member and its attached jaw member;

said operating means including:

a rotatable disc member;

means eccentrically mounting said disc member for rotation about an offset axis; and engagement means connected with said disc member for rotating said disc member about its offset axis;

said rotatable disc member being disposed with its edge engageable against said platen member to act as a cam which moves said platen member toward said base member by operation of said engagement means;

said working jaw members each including a crimping recess;

said apparatus being operative, when metallic sleeve for the multi-strand electrically conductive cable is inserted into the crimping recess on the jaw member attached to the base member, by causing said operating means to move said platen member and the jaw member attached thereto downwardly until such jaw member contacts the metallic sleeve and deforms the same into a crimped portion which engages tightly against the strands of the electrically conductive cable.

2. Apparatus as defined in claim 1 wherein said crimped portion is diamond-shaped in cross-sectional configuration.

3. Apparatus as defined in claim 2 wherein said operating means is a manually operable handle connected with said rotatable disc member.

4. Apparatus as defined in claim 3 wherein said platen member has a freely rotatable member attached to its upper surface and wherein said disc member edge engages against said freely rotatable member.

5. Apparatus as defined in claim 4 further including a pair of upstanding post members projecting from said base member on opposite side of the jaw member attached thereto, said platen member being slidably mounted upon said post members, and biasing springs surrounding said post members and normally urging said platen member away from said base member.

6. Apparatus as defined in claim 5 wherein said crimping recess in each jaw member is generally Y-shaped in cross-sectional configuration.

7. Apparatus as defined in claim 6 wherein each of said jaw members further includes a flat cutting blade, whereby, when said jaw members are moved toward each other, said cutting blades coact to sever said cable.

8. Apparatus as defined in claim 7 wherein each of said jaw members further includes a semi-cylindrical recess, whereby, when said jaw members are moved toward each other, said semi-cylindrical recesses coact to compress said cable.

9. Crimping apparatus for permanently attaching a metallic sleeve onto the stripped portion of a multistrand electrically conductive cable, said apparatus comprising:

a base member;

a pair of posts attached to and projecting upward from said base member, said posts being disposed in spaced parallel relation;

a platen member;

said platen member having a pair of spaced bores therein through which said posts project;

a compression spring surrounding each post, said compression spring reacting between the top of said base member and the bottom of said platen member;

said compression springs conjointly serving to normally bias said platen member away from said base member;

a pair of cap members, one of which is connected to the upper end of each of said posts;

a pivot shaft extending transversely between said cap members;

a circular rotatable disc member having a pair of opposed side faces and a circular peripheral edge extending between said side faces;

said disc member having a transverse bore extending therethrough between said side faces, said bore being offset from the center of said disc member;

said disc member being mounted upon said pivot shaft by having said shaft extend through said transverse bore;

said platen member having a freely movable roller disposed along its upper surface;

said disc member peripheral edge contacting against and being rotatable upon said freely movable roller;

an operating handle attached to and extending radially from said disc member;

a lower jaw member attached to said top of said base member, said lower jaw member being positioned between said posts;

an upper jaw member attached to said bottom of said platen member, said upper jaw member being aligned with and above said lower jaw member;

said apparatus being operative by manual engagement and rotation of said operating handle, which causes said disc member to act as a cam against said platen member and to thus overcome the biasing force of said compression springs, thereby moving said upper jaw member into contact with said lower jaw member;

each of said jaw members having a crimping recess formed therein adapted to receive said cable with said metallic sleeve thereon;

said crimping recesses being operative, when said jaw members are moved into contact with one another, to deform said metallic sleeve and thereby crimp such sleeve onto the underlying strands of said cable.

10. Crimping apparatus as defined in claim 9 wherein each crimping recess is generally Y-shaped in cross-sectional configuration to form a diamond-shaped crimp on said sleeve.

11. Crimping apparatus as defined in claim 10 wherein each jaw member has a knife edge disposed adjacent to its crimping recess whereby, when said jaw members are moved into contact with one another, said knife edges coact to sever an item placed therebetween.

12. Crimping apparatus as defined in claim 10 wherein each jaw member has a semi-cylindrical recess disposed adjacent to its crimping recess whereby, when said jaw members are moved into contact with one another, said semi-cylindrical recesses form a cylindrical recess which leaves a cylindrical impression on an item placed therebetween.

13. Crimping apparatus as defined in claim 10 wherein each jaw member has vertical grooves formed on opposite sides of said crimping recess and wherein one of said jaw members has guide plates disposed within and projecting from said vertical grooves, said guide plates being adapted to fit into the vertical grooves on the other jaw member when said jaw members are moved into contact with one another.

* * * * *